US008118568B2

(12) United States Patent
Inagaki et al.

(10) Patent No.: US 8,118,568 B2
(45) Date of Patent: Feb. 21, 2012

(54) HERMETIC COMPRESSOR

(75) Inventors: Ko Inagaki, Kanagawa (JP); Masanori Kobayashi, Kanagawa (JP); Terumasa Ide, Kanagawa (JP); Tomio Maruyama, Kanagawa (JP)

(73) Assignee: Panasonic Corporation, Osaka (JP)

( * ) Notice: Subject to any disclaimer, the term of this patent is extended or adjusted under 35 U.S.C. 154(b) by 610 days.

(21) Appl. No.: 10/575,454

(22) PCT Filed: Dec. 6, 2005

(86) PCT No.: PCT/JP2005/022725

§ 371 (c)(1),
(2), (4) Date: Apr. 12, 2006

(87) PCT Pub. No.: WO2006/062223

PCT Pub. Date: Jun. 15, 2006

(65) Prior Publication Data

US 2008/0247886 A1 Oct. 9, 2008

(30) Foreign Application Priority Data

Dec. 6, 2004 (JP) ..... 2004-352446

(51) Int. Cl.
*F04B 39/00* (2006.01)

(52) U.S. Cl. ..... 417/312; 181/229; 181/403

(58) Field of Classification Search ..... 417/312; 181/403, 229

See application file for complete search history.

(56) References Cited

U.S. PATENT DOCUMENTS 3,750,840 A * 8/1973 Holme ..... 181/269
4,911,619 A * 3/1990 Todescat et al. ..... 417/312
5,201,640 A 4/1993 Heinzelmann et al.
5,252,035 A 10/1993 Lee (Continued)

FOREIGN PATENT DOCUMENTS

EP 1 338 795 8/2003

(Continued)

OTHER PUBLICATIONS

Patent Abstracts of Japan, vol. 2003, No. 12, Dec. 5, 2003 & JP 2004 293464 A (Matsushita Electric Ind. Co., Ltd.), Oct. 21, 2004, Abstract; Figures 2-4.

(Continued)

*Primary Examiner* — Devon C Kramer
*Assistant Examiner* — Philip Stimpert
(74) *Attorney, Agent, or Firm* — Wenderoth, Lind & Ponack, L.L.P.

(57) ABSTRACT

A hermetic compressor has a hermetic container storing oil, and a compressing element accommodated in the hermetic container and compressing a refrigerant gas. The compressing element has a compression chamber, a cylinder forming the compression chamber, a piston inserted into the cylinder for reciprocation, and a suction muffler whose one end communicates with the compression chamber. The suction muffler has a sound deadening space, a gas flow forming part forming a gas flow flowing in a constant direction in the sound deadening space, and an oil discharge opening provided in a downstream side of the gas flow in a lower part of the sound deadening space. By this construction, there is realized a hermetic compressor in which the oil does not readily remain in the suction muffler, whose noise is lower, and whose performance is stabilized.

22 Claims, 7 Drawing Sheets

U.S. PATENT DOCUMENTS

| | | | | |
|---|---|---|---|---|
| 6,206,135 | B1 | 3/2001 | Kim et al. | |
| 6,361,290 | B1 * | 3/2002 | Ide | 417/312 |
| 6,415,888 | B2 | 7/2002 | An et al. | |
| 7,381,032 | B2 | 6/2008 | Osaka et al. | |
| 2004/0179955 | A1 * | 9/2004 | Lee | 417/312 |

FOREIGN PATENT DOCUMENTS

| | | |
|---|---|---|
| JP | 50-75407 | 7/1975 |
| JP | 5-69381 | 9/1993 |
| JP | 2002-161855 | 6/2002 |
| KR | 2001-0111535 | 12/2001 |

OTHER PUBLICATIONS

Patent Abstracts of Japan, vol. 2000, No. 08, Oct. 6, 2000 & JP 2000-130147 A (Matsushita Refrigeration Co., Ltd.), May 9, 2000, Abstract; Figures 1-8.

Patent Abstracts of Japan, vol. 2003, No. 04, Apr. 2, 2003 & JP 2002-349436 A (Matsushita Refrigeration Co., Ltd.), Dec. 4, 2002, Abstract.

English translation of JP 2002-349436, which was cited in the Information Disclosure Statement filed Apr. 12, 2006.

* cited by examiner

FIG. 9 – PRIOR ART
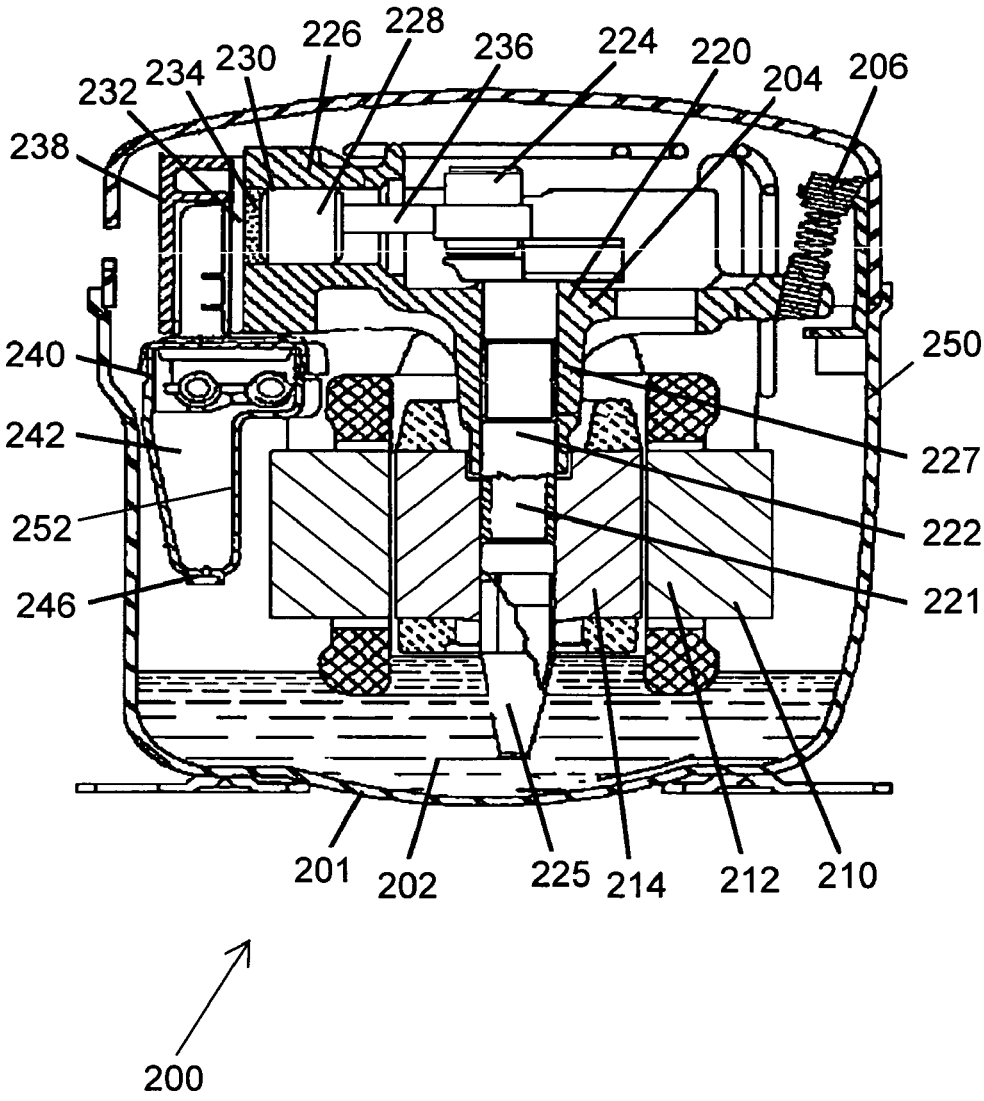

FIG. 10 – PRIOR ART
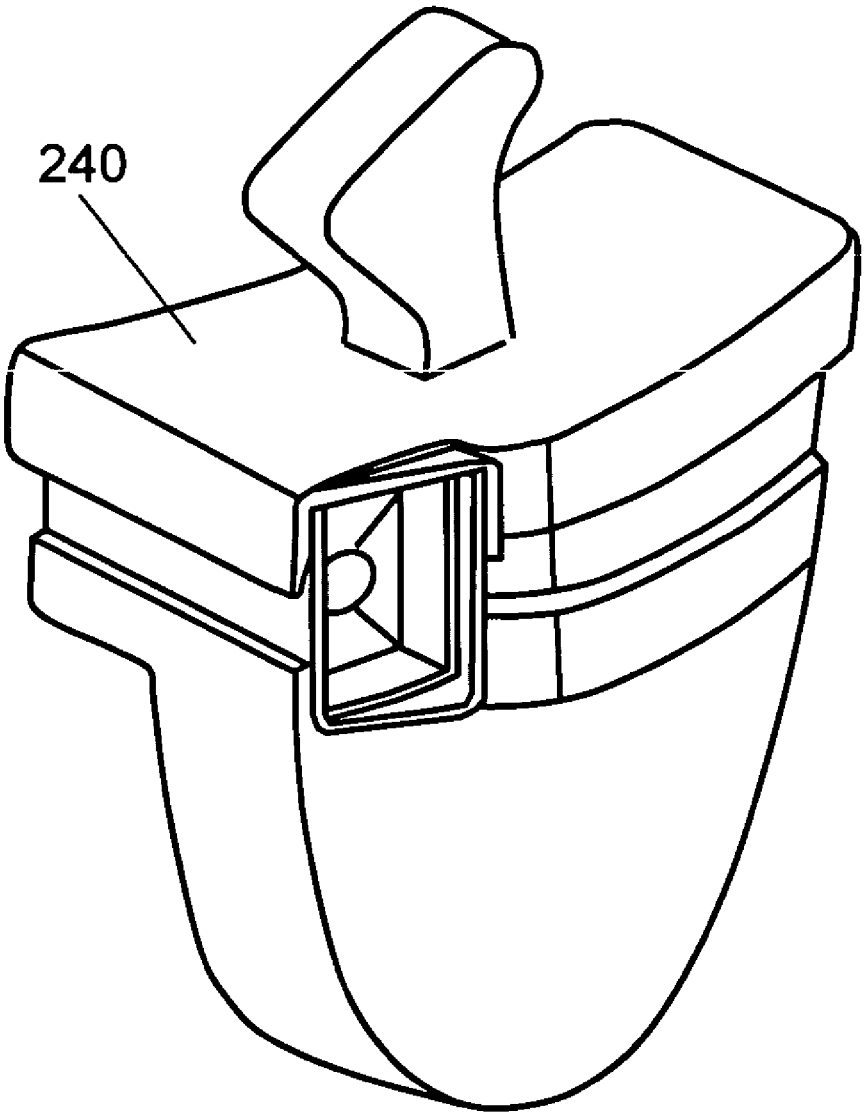

HERMETIC COMPRESSOR

This application is a U.S. national phase application of PCT international application PCT/JP2005/022725, filed Dec. 6, 2005.

TECHNICAL FIELD

The present invention relates to a hermetic compressor used in a refrigerating cycle of an electric refrigerator for household and professional uses, and the like.

BACKGROUND ART

In recent years, demand for global environmental protection has become increasingly strong. For this reason, in refrigerators, other refrigerating cycle apparatus and the like, it is especially strongly desired to increase efficiency.

Hitherto, in the hermetic compressor utilized in refrigerators, refrigerating cycle apparatus and the like, there has been used a resin suction muffler. These conventional hermetic compressors are disclosed in, for example, Japanese Patent Unexamined Publication No. H05-195953 and the like.

Hereunder, the conventional hermetic compressor is explained with reference to the drawings.

FIG. 9 shows a longitudinal sectional view of the conventional hermetic compressor. FIG. 10 shows a perspective view of a suction muffler used in the conventional hermetic compressor.

In FIG. 9 and FIG. 10, oil 202 is stored in a bottom part of hermetic container 201 (hereafter referred to as "container 201"). Compressing member 204 (hereafter referred to as "member 204") is supported elastically with respect to container 201 by suspension spring 206.

Member 204 is constituted by motor element 210, and compressing element 220 disposed above motor element 210. Motor element 210 is constituted by stator 212 and rotor 214.

Compressing element 220 has crank shaft 221 (hereafter referred to as "shaft 221"). Shaft 221 is constituted by main shaft 222 and eccentric shaft 224. Main shaft 222 is supported rotatably with respect to bearing 227 provided in block 226. Rotor 214 is fixed to main shaft 222. Additionally, shaft 221 has oil supplying mechanism 225.

Further, piston 228 is inserted so as to be capable of reciprocating with respect to cylinder 230 monolithically formed in block 226. Cylinder 230 forms, together with valve plate 232 (hereafter referred to as "plate 232"), compression chamber 234.

A piston pin (not shown in the drawing) attached to piston 228 is inserted rotatably with respect to coupling part 236 to constitute a coupling means. Eccentric shaft 224 is inserted rotatably with respect to coupling part 236. By this construction, coupling part 236 couples eccentric shaft 224 and piston 228.

Cylinder head 238 covers plate 232. Suction muffler 240 (hereafter referred to as "muffler 240") is retained by cylinder head 238 and plate 232 while being nipped. Muffler 240 is molded and formed by a resin such as poly-butylene terephthalate. Inside muffler 240, there is provided sound deadening space 242 whose inside face has been formed approximately like a circular cone. In a lower end of muffler 240, there is provided oil discharge opening 246 (hereafter referred to as "opening 246"). In this manner, hermetic compressor 200 (hereafter referred to as "compressor 200") is constituted.

Next, operation of compressor 200 is explained.

When an electric current is applied to motor element 210, stator 212 generates a rotating magnetic field. By this rotating magnetic field, rotor 214 rotates together with main shaft 222. By the rotation of main shaft 222, eccentric shaft 224 eccentrically moves. An eccentric motion of eccentric shaft 224 is transmitted to piston 228 through coupling part 236. As a result, piston 228 reciprocates in cylinder 230. A refrigerant gas (not shown in the drawing) having returned from a refrigerating cycle (not shown in the drawing) outside container 201 is introduced into compression chamber 234 through muffler 240. The refrigerant gas introduced into compression chamber 234 is compressed in compression chamber 234 by piston 228. The compressed refrigerant gas is sent again to the refrigerating cycle outside container 201.

On the occasion of this refrigerant compression, noise is generated by an intermittent suction of the refrigerant gas. Muffler 240 serves to reduce the generated noise. Additionally, by the fact that muffler 240 is formed by the resin whose heat transfer is small, heating of the refrigerant gas is prevented. By this fact, a decrease in performance of compressor 200 is prevented.

Additionally, by utilizing actions of a centrifugal force generated by the rotation of shaft 221, and the like, oil supplying mechanism 225 supplies oil 202 stored in the bottom part of container 201 to upper compressing element 220. Oil 202 supplied to compressing element 220 lubricates some sliding portions of bearing 227 and the like. Thereafter, oil 202 is dispersed from an upper end of shaft 221 to the environment by the centrifugal force of main shaft 222. Dispersed oil 202 lubricates members such as piston 228 and cylinder 230. Additionally, oil 202 adheres to inside wall surface 250 of container 201, and flows down to the bottom part of container 201 along inside wall surface 250. As oil 202 flows down along inside wall surface 250, heat is conducted from oil 202 to container 201. The heat conducted to container 201 is radiated to the outside of hermetic compressor 200 through a wall surface material of container 201. By this fact, a cooling of compressor 200 is performed.

Further, oil 202 having dispersed from the upper end of shaft 221 is sucked also into muffler 240 with a flow of the refrigerant gas. The flow of the refrigerant gas is released into sound deadening space 242 in muffler 240, and its velocity decreases. When the flow velocity of the refrigerant gas decreases, oil 202 drops to a lower part of sound deadening space 242. Oil 202 having dropped into sound deadening space 242 flows down along inside wall surface 252 of sound deadening space 242. Oil 202 having flowed down collects to a lower end of sound deadening space 242. Thereafter, oil 202 having collected to the lower end of sound deadening space 242 is discharged from opening 246 to the outside of muffler 240.

However, in the above configuration of conventional compressor 200, it is difficult to contrive a miniaturization of muffler 240 with an inside shape of sound deadening space 242 maintained in a shape like the circular cone. This fact hinders the miniaturization of compressor 200.

That is, in order for muffler 240 to achieve a sound deadening function, sound deadening space 242 necessitates a spatial volume (width or depth of sound deadening space 242) larger than a certain value. Further, in order for oil 202 to flow to opening 246 along inside wall surface 252, sound deadening space 242 is shaped like the circular cone having an angle of a certain degree. Thereupon, for muffler 240, a height of a certain degree becomes necessary, so that opening 246 approaches a liquid level of oil 202 stored in the bottom part of container 201.

However, the liquid level of oil 202 stored in the bottom part of container 201 changes by an operating state of compressor 200. Especially, at start-up of compressor 200, a refrigerant gas having dissolved in oil 202 bubbles out due to a pressure drop in container 201. For this reason, the liquid level of oil 202 ascends, so that opening 246 is immersed in oil 202. Additionally, an average pressure in sound deadening space 242 is low in comparison with that in container 201. As a result, a large quantity of oil 202 enters through opening 246 into sound deadening space 242, so that oil 202 is liable to remain in muffler 240.

Further, it is considered to dispose opening 246 while being separated from oil 202 in the bottom part of container 201 by reducing an incline of inner wall surface 252 to thereby suppress a height of muffler 240 to a low level. However, a dropping velocity of oil 202 flowing down along inner wall surface 252 becomes slow, so the oil 202 is not discharged sufficiently from sound deadening space 242. As a result, similarly, oil 202 is liable to remain in muffler 240.

Like this, if the large quantity of oil 202 remains in muffler 240, when the refrigerant gas is sucked into compressing chamber 234, oil 202 is raised, so that the large quantity of oil 202 is sucked into compressing chamber 234.

If the large quantity of oil 202 flows into compressing chamber 234, a load during compressing becomes large. As a result, an input energy of compressor 200 increases. Or, the refrigerant gas is not compressed sufficiently, so that a refrigerating ability of compressor 200 decreases. Further, by the fact that a compressing load and the like abruptly fluctuate, the noise of the compressor 200 becomes larger. Additionally, heat exchanger performance is influenced by the fact that the large quantity of oil 202 is discharged to the refrigerating cycle.

SUMMARY OF THE INVENTION

A hermetic compressor of the present invention has a hermetic container storing oil, and a compressing element accommodated in the hermetic container and compressing a refrigerant gas; the compressing element has a compression chamber, a cylinder forming the compressing chamber, a piston inserted into the cylinder and reciprocating, and a suction muffler whose one end communicates with the compression chamber; and the suction muffler has a sound deadening space, a gas flow forming part forming a gas flow flowing in a constant direction in the sound deadening space, and an oil discharge opening provided in a downstream side of the gas flow in a lower part of the sound deadening space. By this construction, there is realized a hermetic compressor in which the oil does not readily remain in the suction muffler, whose noise is lower, and whose performance is stabilized.

BRIEF DESCRIPTION OF THE DRAWINGS

FIG. 9 is a longitudinal sectional view of a conventional hermetic compressor.

FIG. 10 is a perspective view of a suction muffler used in the conventional hermetic compressor.

DETAILS DESCRIPTION OF THE INVENTION

Hereunder, there is explained about an embodiment of the present invention is explained with reference to the drawings.

Figure 1:
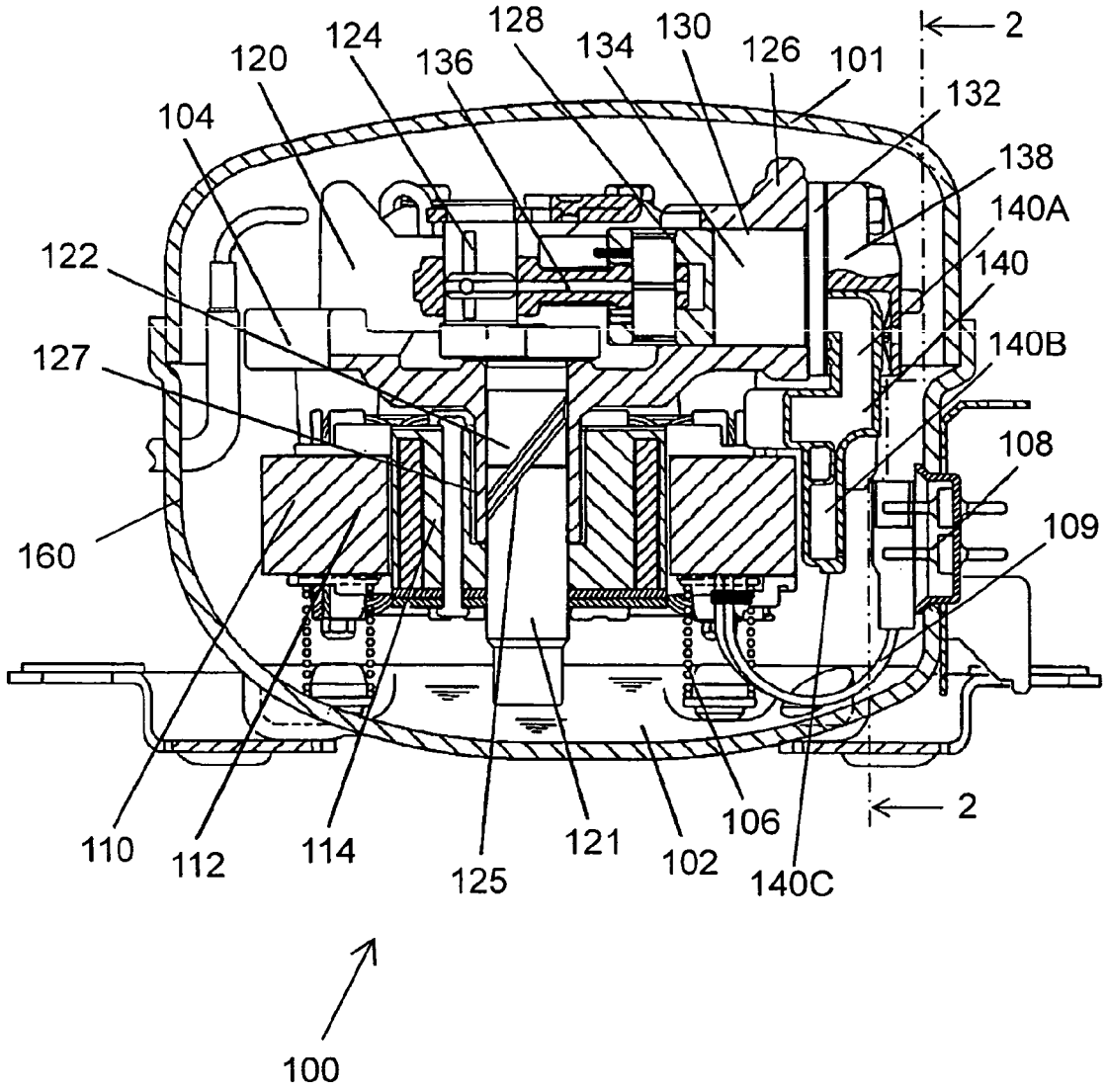
FIG. 1 is a longitudinal sectional view of a hermetic compressor in an embodiment of the present invention.
Figure 2:
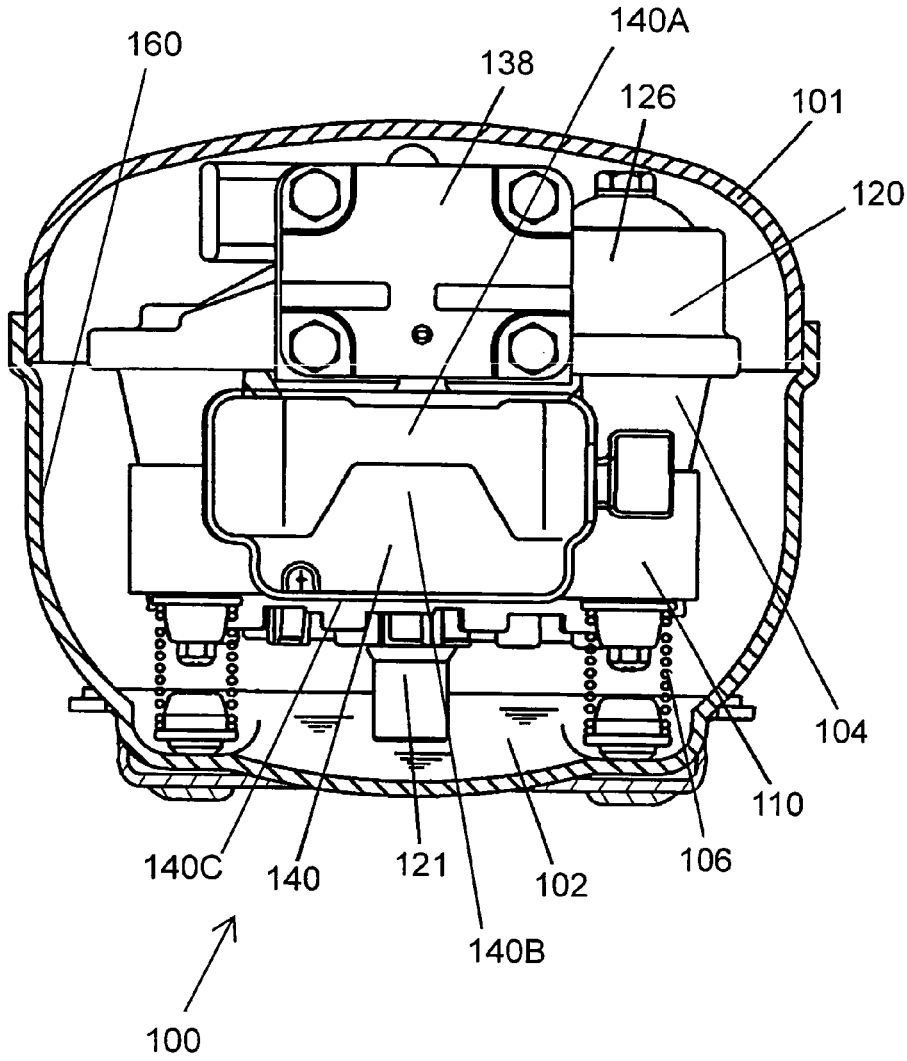
FIG. 2 is a sectional view along a line 2-2 line of the hermetic compressor shown in FIG. 1.
Figure 3:
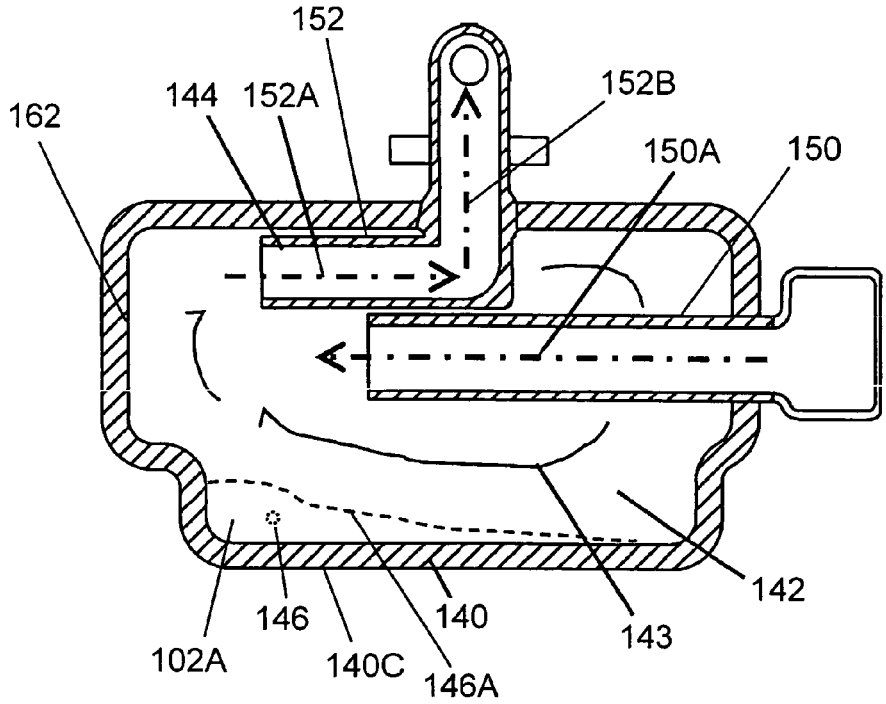
FIG. 3 is a sectional view of a suction muffler used in the hermetic compressor shown in FIG. 1.
Figure 4:
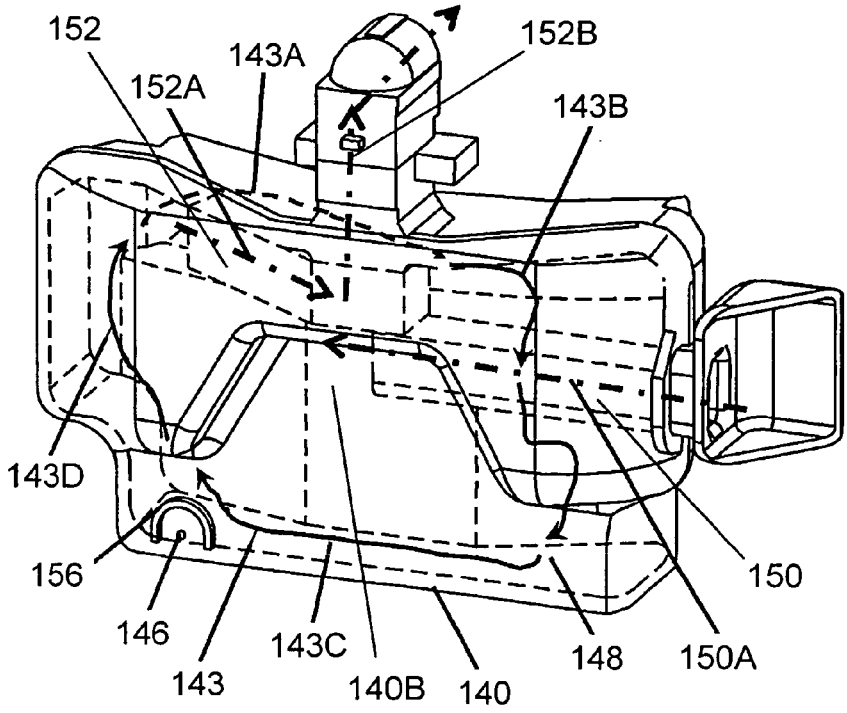
FIG. 4 is a perspective view of the suction muffler shown in FIG. 3.

FIG. 1 is a longitudinal sectional view of a hermetic compressor in an embodiment of the present invention. FIG. 2 is a sectional view along line 2-2 of the hermetic compressor shown in FIG. 1. FIG. 3 is a sectional view of a suction muffler used in the hermetic compressor shown in FIG. 1. FIG. 4 is a perspective view of the suction muffler shown in FIG. 3.

In FIG. 1 to FIG. 4, oil 102 is stored in a bottom part inside hermetic container 101 (hereafter referred to as "container 101"). Additionally, there is accommodated compressing member 104 (hereafter referred to as "member 104") inside container 101. Member 104 is constituted by motor element 110 and compressing element 120 driven by motor element 110. Member 104 is supported elastically with respect to container 101 by suspension spring 106. Further, inside container 101, there is filled a hydrocarbon refrigerant gas, such as R600a for instance, whose global warming potential is low. Further, power source terminal 108 is attached to container 101 for supplying power from a power source to motor element 110. In this manner, hermetic compressor 100 (hereafter referred to as "compressor 100") is constituted.

First, motor element 110 is described.

Motor element 110 forms a salient pole concentrated winding-type DC brushless motor. Motor element 110 has stator 112 and rotor 114. Motor element 110 is connected to an inverter drive circuit (not shown in the drawings) by lead wire 109 through power source terminal 108.

Stator 112 is formed with a winding being wound around magnetic pole teeth of an iron core of stator 112 through an insulating material. The iron core of stator 112 is formed by so-called flat-rolled electromagnetic steel sheets and strip (silicon steel plate), such as non-oriented magnetic sheets and strip (JIS C2552) for instance, whose iron loss is low. For the iron core of stator 112, it is desirable to use the flat-rolled electromagnetic steel sheets and strip whose thickness is 0.7 mm or less, and whose iron loss is 7 W/kg or less. Additionally, for the iron core of stator 112, it is desirable to use the flat-rolled magnetic steel sheets and strip whose thickness is 0.35 mm, and whose iron loss is as low as 0.4 W/kg or less.

Rotor 114 is disposed inside stator 112. Rotor 114 is constituted by an iron core of rotor 114, and a permanent magnet disposed inside the iron core of rotor 114. As the permanent magnet, there is used a rare earth magnet such as neodymium for instance. Further, rotor 114 is fixed to main shaft 122 constituting crank shaft 121 (hereafter referred to as "shaft 121"). Similarly to the iron core of stator 112, the iron core of rotor 114 is also formed with the flat-rolled electromagnetic steel sheets and strip, such as non-oriented electromagnetic sheets and strip (JIS C2552), being laminated.

Further, motor element 110 is operated at various frequencies between 15 r/sec (revolutions per second) and 75 r/sec by an inverter drive.

Next, details of compressing element 120 are explained.

Compressing element 120 is disposed above motor element 110.

Shaft 121 constituting compressing element 120 has main shaft 122 and eccentric shaft 124. A lower end part of main shaft 122 is immersed in oil 102 stored in the bottom part of container 101. In shaft 121, there is provided oil supplying mechanism 125 which communicates from the lower end part of main shaft 122 to an upper end part of eccentric shaft 124 and which is for supplying oil 102 to an upper part of compressing element 120. In block 126, there are provided bearing 127 and cylinder 130. Bearing 127 rotatably supports main shaft 122.

Piston 128 is fitted to and inserted into cylinder 130 so as to be capable of reciprocating therein. Valve plate 132 (hereafter referred to as "plate 132") is disposed at an end face of cylinder 130. Compression chamber 134 is formed by cylinder 130 and plate 132. Piston 128 and eccentric shaft 124 are connected by coupling part 136 that constitutes a coupling means.

Suction muffler 140 (hereafter referred to as "muffler 140") is fixed by the fact that it is supported while being nipped by plate 132 and cylinder head 138. Muffler 140 is formed by a synthetic resin, such as poly-butylene terephthalate, that is a crystalline resin to which glass fibers have been mainly added.

Additionally, sound deadening space 142 is formed inside muffler 140. Muffler 140 has inlet pipe 150 and outlet pipe 152. One end of pipe 150 opens into sound deadening space 142, and the other end of inlet pipe 150 opens into container 101. One end of pipe 152 opens into sound deadening space 142, and the other end of outlet pipe 152 opens into compression chamber 134.

A back face side of muffler 140 adjoins stator 112 and block 126. Muffler 140 has an external shape extending along stator 112 and block 126.

Further, as shown in FIG. 1 and FIG. 4, lower portion 140B in a front face side of muffler 140 is thinner in its thickness than upper portion 140A in order to secure a distance from power source terminal 108. Lower portion 140B has a shape which is thinner in its center part in comparison with its left and right parts. Additionally, lower surface 140C of muffler 140 is formed by a substantially horizontal face. Lower surface 140C is disposed a certain distance from oil 102 stored in the bottom part of container 101.

As shown in FIG. 3 and FIG. 4, outlet pipe 152 extends in an approximately horizontal direction along a wall surface in an upper end of sound deadening space 142. A tip of outlet pipe 152 opens in the vicinity of the wall surface in the upper end of sound deadening space 142.

The refrigerant gas flows out as gas flows 152A, 152B which are indicated by arrows of alternate long and short dash lines while passing through outlet pipe 152 from sound deadening space 142. By the flow of the flowing-out refrigerant gas, annular gas flow 143 is generated in a clockwise direction along an outer periphery in sound deadening space 142. In other words, gas flow forming part 144 forming gas flow 143 is formed by outlet pipe 152.

Next, annular gas flow 143 formed inside sound deadening space 142 is explained in detail with reference to FIG. 4.

In FIG. 4, a tip of inlet pipe 150 opens in a horizontal direction in an approximate center inside sound deadening space 142. Inlet pipe 150 is constituted such that there is formed gas flow 150A in which the refrigerant gas flows in a direction from right to left. Further, outlet pipe 152 is disposed in a front side of an upper end part of sound deadening space 142. Outlet pipe 152 is constituted such that there is formed gas flow 152A in which the refrigerant gas flows in a direction from left to right.

Above inlet pipe 150, sound deadening space 142 has a space in a back face side of outlet pipe 152. Further, also below inlet pipe 150, sound deadening space 142 has a space whose depth is small. Further, at a height approximately the same as inlet pipe 150, sound deadening space 142 has a space extending in front sides of left and right. These spaces of four places in upper end, lower end, left end and right end respectively communicate with each other.

Further, inlet pipe 150 is formed monolithically with a wall surface in its back face side. Still further, in the vicinity of an opening part of inlet pipe 150 with respect to sound deadening space 142, an interstice scarcely exists between inlet pipe 150 and the wall surface in front side. Accordingly, an internal structure of sound deadening space 142 becomes a doughnut-like space in which the above-mentioned upper, lower, left and right spaces have communicated so as to surround the opening part of inlet pipe 150. Accordingly, sound deadening space 142 forms in its inside annular gas passage 148.

Additionally, sound deadening space 142 has a shape whose lateral width is wide in comparison with its height. Further, lower surface 140C of sound deadening space 142 is constituted by the approximately horizontal face. In the vicinity of a bottom part of muffler 140, in other words, in a lower part of sound deadening space 142 and in a side face in a downstream side of gas flow 143, there is provided oil discharge opening 146 (hereafter referred to as "opening 146").

Operations and actions of hermetic compressor 100, constituted as described above, are explained below.

When the electric current is applied to motor element 110 by the inverter drive circuit, rotor 114 rotates together with main shaft 122 due to a magnetic field occurring in stator 112. With a rotation of main shaft 122, eccentric shaft 124 eccentrically rotates. An eccentric motion of eccentric shaft 124 is converted into a reciprocating motion through coupling part 136. By this fact, piston 128 reciprocates in cylinder 130. By the fact that piston 128 reciprocates in cylinder 130, the refrigerant gas in container 101 is sucked into compression chamber 134. Additionally, the refrigerant gas is compressed in compression chamber 134. In other words, a suction operation and a compression operation of the refrigerant gas are performed.

In a suction process of the refrigerant gas with the compression operation, the refrigerant gas in container 101 is intermittently sucked into compression chamber 134 through muffler 140. After being compressed, the sucked refrigerant gas is sent to the refrigerating cycle (not shown in the drawings) provided outside container 101 through discharge piping (not shown in the drawings) and the like.

Muffler 140 constitutes an expansion type muffler including inlet pipe 150, outlet pipe 152 and sound deadening space 142. Muffler 140 has a function of reducing the noise which occurs by the intermittent suction of the refrigerant gas. Further, muffler 140 is formed by poly-butylene terephthalate resin etc. whose heat transfer is extremely small in comparison with metal and the like. By this fact, there is prevented a temperature rise of the refrigerant gas which returns to compression chamber 134 from the refrigerating cycle through muffler 140. The refrigerant gas which returns to compression chamber 134 from the refrigerating cycle through muffler 140 has comparatively low temperature, so that the refrigerant gas maintains a low temperature. As a result, a decrease in performance of compressor 100 is prevented.

Oil supplying mechanism 125 carries oil 102 stored in the bottom part of container 101 to the upper part of compressing element 120 by utilizing the centrifugal force obtained by a rotation of shaft 121, a viscous, frictional force occurring in a sliding part, and the like. Oil 102 carried to compressing element 120 performs lubrication of each of the sliding parts of main shaft 122 and eccentric shaft 124. Additionally, it is dispersed into container 101 from an upper end part of shaft 121. Dispersed oil 102 showers down on each of the sliding parts of piston 128 and cylinder 130, thereby performing the lubrication. The temperature of oil 102 rises as the oil 102 lubricates the sliding parts due to the influence of frictional heat of the sliding parts, and the like. Oil 102 having risen in temperature adheres to inside wall surface 160 of container 101. Oil 102 having adhered to inside wall surface 160 flows down to a lower part of container 101 along inside wall surface 160. As oil 102 flows down to the lower part of container 101, thermal energy of oil 102 is radiated to the outside of container 101 through container 101, in other words, with container 101 as a heat transfer material. This causes cooling of an inside of compressor 100.

Additionally, one part of oil 102 having dispersed into container 101 is sucked into muffler 140 via inlet pipe 150 that opens into container 101. Oil 102 having entered into muffler 140 is sucked to sound deadening space 142 through inlet pipe 150. When the refrigerant gas is sucked to sound deadening space 142 and its pressure is released, oil 102 drops to the bottom part of sound deadening space by gravity.

As shown in FIG. 3 and FIG. 4, by the velocity of the refrigerant gas flowing to outlet pipe 152, the refrigerant gas in sound deadening space 142 is energized and, in the back face side of outlet pipe 152, gas flow 143A flows from left to right. Further, annular gas passage 148 is formed in sound deadening space 142. By these facts, there occur gas flow 143B, gas flow 143C and gas flow 143D, so that annular gas flow 143 cycling in sound deadening space 142 is formed. Gas flow 143B is a gas flow which flows, in a right side of sound deadening space 142, downwardly at a front side of inlet pipe 150. Further, gas flow 143C is a gas flow which flows, in a lower end of sound deadening space 142, from right to left. Additionally, gas flow 143D is a gas flow which flows upwardly in a left side of sound deadening space 142.

Oil 102 having dropped to the bottom part of sound deadening space 142 is conveyed to a vicinity of opening 146 by gas flow 143C. Oil 102 conveyed to the vicinity of opening 146 becomes oil pool 102A which seals opening 146. As shown by broken line 146A in FIG. 3, a liquid level of oil pool 102A attains an oblique slanting face due to gas flow 143C.

As to a pressure in muffler 140, a negative pressure and a positive pressure alternately occur with respect to a pressure in container 101. In other words, muffler 140 is respiring. For this reason, through opening 146, there are alternately repeated a process in which oil 102 is discharged from muffler 140 to container 101 and a process in which the refrigerant gas is sucked from container 101 into muffler 140. By this fact, oil 102 having collected in the vicinity of opening 146 is intermittently discharged into container 101.

As a result, oil 102 does not readily remain in muffler 140, so that there is no fact that a large quantity of oil 102 remains in muffler 140. The large quantity of oil 102 is prevented from being sucked to compressing chamber 134.

The refrigerant gas in sound deadening space 142 is energized by gas flow 152A of the refrigerant gas flowing out through outlet pipe 152, so that annular gas flow 143 is formed in the inner circumference of sound deadening space 142. In other words, gas flow forming part 144 forming gas flow 143 is constituted by outlet pipe 152 which opens in the approximately horizontal direction along the wall surface in the upper end of sound deadening space 142. Accordingly, there is no necessity to add such a particular component as to provide, e.g., a special fan for generating gas flow 143C. In other words, gas flow forming part 144 is constituted without an accompanying increase in cost.

Further, at start-up of compressor 100, it may occur that a non-gasified liquid-like refrigerant flows into compressor 100 from the refrigerating cycle. Further, it may also occur that the pressure in container 101 abruptly decreases and thus the refrigerant gas having dissolved in oil 102 bubbles out. By these facts, it may occur that oil 102 and the liquid-like refrigerant flow into muffler 140, drop into sound deadening space 142 by gravity, and remain in the bottom part of sound deadening space 142.

However, outlet pipe 152 is provided near an upper end face of sound deadening space 142 and sufficiently separated from lower surface 140C. For this reason, even if certain quantities of oil 102 and the liquid-like refrigerant are accumulated in the bottom part of sound deadening space 142, oil 102 and the liquid-like refrigerant are prevented from being sucked in large quantities into compression chamber 134 through outlet pipe 152. As a result, there are prevented an occurrence of noise from compressor 100, and breakage of components of compressor 100, such as a valve (not shown in the drawings).

Further, lower surface 140C of sound deadening space 142 is constituted by the approximately horizontal face. Additionally, opening 146 is disposed near an end part in a downstream side of gas flow 143C in the vicinity of lower surface 140C. By these facts, a dimension in a height direction is suppressed to a small value and, also in muffler 140, a volume of sound deadening space 142 is secured and a certain distance is secured between opening 146 and oil 102 stored in the bottom part of container 101.

The pressure in container 101 abruptly decreases at the start-up of compressor 100, and the refrigerant gas having dissolved in oil 102 bubbles out, so that the liquid level of oil 102 may be raised. Even if the liquid level of oil 102 has raised, oil 102 and the liquid-like refrigerant are prevented from flowing into muffler 140 via inlet pipe 150 and opening 146. For this reason, oil 102 and the liquid-like refrigerant are prevented from being sucked in large quantity into compression chamber 134. By this fact, the occurrence of the noise is prevented and, at the same time, a performance of compressor 100 is stabilized.

Further, motor element 110 is the salient pole concentrated winding-type DC brushless motor, and is smaller in dimension in the height direction than a distributed winding induction motor. Accordingly, the dimension in the height direction is suppressed to a small value while a certain content volume of muffler 140 is secured. Additionally, oil 102 is prevented from remaining inside muffler 140. By this fact, the noise of compressor 100 is reduced, and the performance of compressor 100 is stabilized, while miniaturization of compressor 100 is achieved.

Especially, with motor element 110 in which a rare earth magnet capable of obtaining a strong magnetic force is used, there is realized compressor 100 in which the dimension in the height direction is additionally suppressed to a small value. Accordingly, even if the height of muffler 140 is low, there remarkably appears an advantage that residence of oil 102 in muffler 140 is prevented. As a result, the height of compressor 100 is additionally suppressed to the small value.

Further, the centrifugal force acts on annular gas flow 143 formed in sound deadening space 142. By this fact, oil 102 contained in the refrigerant gas is centrifugally separated. Oil 102 centrifugally separated adheres to inside wall surface 162 of sound deadening space 142 and flows down to the bottom part of sound deadening space 142 along inside wall surface 162. For this reason, an inflow of oil 102 into compression chamber 134 is additionally suppressed. As a result, noise is additionally reduced, and the performance of compressor 100 becomes additionally stable.

Further, annular gas flow 143 is formed in sound deadening space 142. By this fact, gas flow 143C is not readily disturbed, and stable, strong gas flow 143C in a constant direction is formed. Stable and strong gas flow 143C in the constant direction additionally ensures the flow of oil 102 discharged from muffler 140 through opening 146.

There is provided a visor 156 protruding like an eaves, in an upper side of opening 146. If a large quantity of oil 102 adheres to an outer surface of muffler 140 near opening 146, oil 102 could be sucked into muffler 140 from opening 146. By this fact, there is a possibility that a large quantity of oil 102 accumulates in muffler 140. However, by the fact that visor 156 is provided, oil 102 flowing down along the outer surface of muffler 140 is prevented from accumulating around opening 146. As a result, there is avoided the suction of oil 102 from an outside to an inside of muffler 140 through opening 146.

Additionally, compressor 100 is operated in a number of revolutions of a wide range with an inverter control used. For this reason, a quantity of the dispersion of oil 102 from shaft 121 greatly changes by the number of revolutions. However, in a high rotation operation in which the large quantity of oil 102 disperses and oil 102 is liable to be sucked into muffler 140, gas flows 143, 143C in sound deadening space 142 become strong as well. For this reason, oil 102 having accumulated in the bottom part of sound deadening space 142 is liable to collect in a vicinity of opening 146. As a result, a discharge of oil 102 from muffler 140 through opening 146 is expedited, so that there is prevented an abnormal increase of oil pool 102A in muffler 140.

Additionally, by the fact that a flow velocity of annular gas flow 143 increases, the centrifugal force applied to the refrigerant gas in sound deadening space 142 increases. As a result, a centrifugally separating ability with respect to oil 102 contained in the refrigerant gas additionally increases as well.

Accordingly, even if compressor 100 is operated in a wide operation range, there is prevented the suction of oil 102 into compression chamber 134. As a result, the performance of compressor 100 is stabilized.

Opening 146 has been described as being provided in a side face of muffler 140. However, there may be a construction in which the opening is provided in the bottom part or lower surface 140C of muffler 140.

Gas flow forming part 144 has been described as being formed by outlet pipe 152 which opens into sound deadening space 142 while extending in the approximately horizontal direction along the wall surface in the upper end of sound deadening space 142. However, the gas flow forming part 144 is not necessarily limited to outlet pipe 152 extending in the approximately horizontal direction along the wall surface in the upper end of sound deadening space 142.

Figure 5:
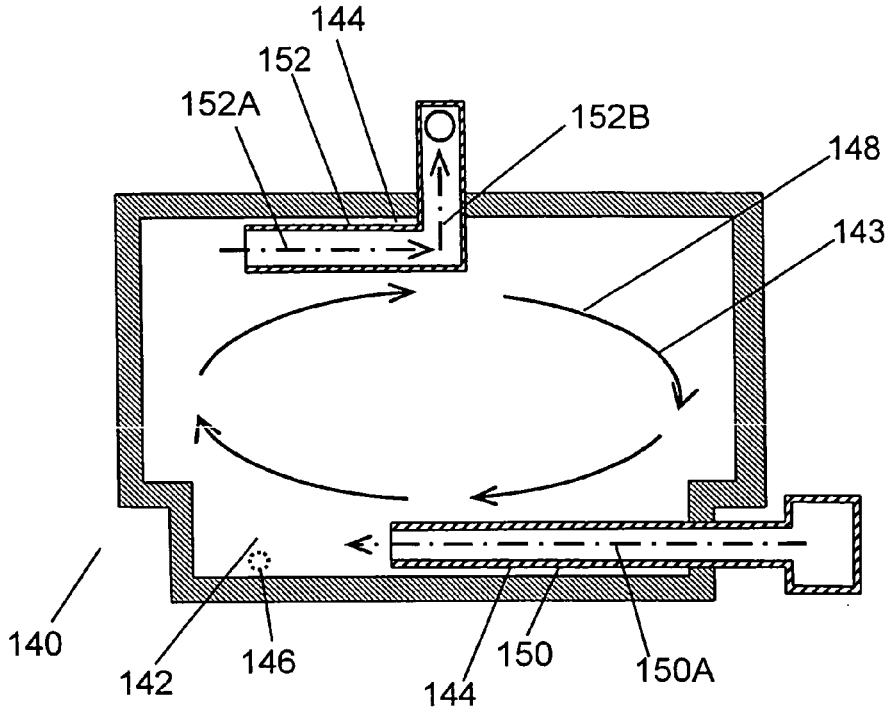
FIG. 5 is a sectional view of a suction muffler used in the hermetic compressor shown in FIG. 1.

For example, as shown in FIG. 5, gas flow forming part 144 may be constituted by inlet pipe 150 which opens into sound deadening space 142 while extending in the approximately horizontal direction along the wall surface in a lower end of sound deadening space 142.

Figure 6:
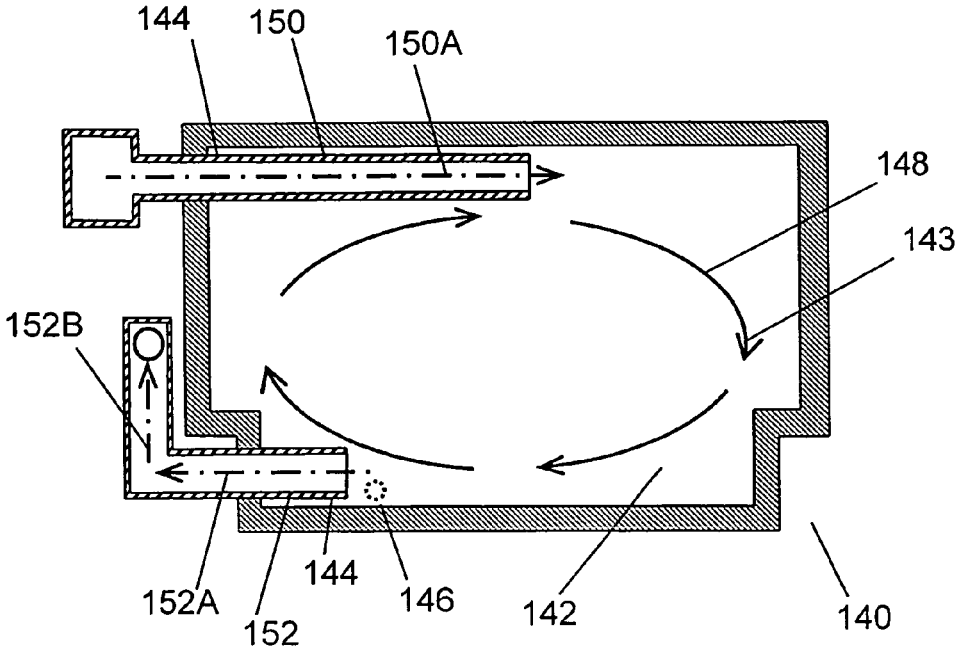
FIG. 6 is a sectional view of a suction muffler used in the hermetic compressor shown in FIG. 1.

Further, as shown in FIG. 6, gas flow forming part 144 may be constituted by outlet pipe 152 which opens into sound deadening space 142 while extending in the approximately horizontal direction along the wall surface in the lower end of sound deadening space 142. Further, gas flow forming part 144 may be constituted by inlet pipe 150 which opens into sound deadening space 142 while extending in the approximately horizontal direction along the wall surface in the upper end of sound deadening space 142.

Figure 7:
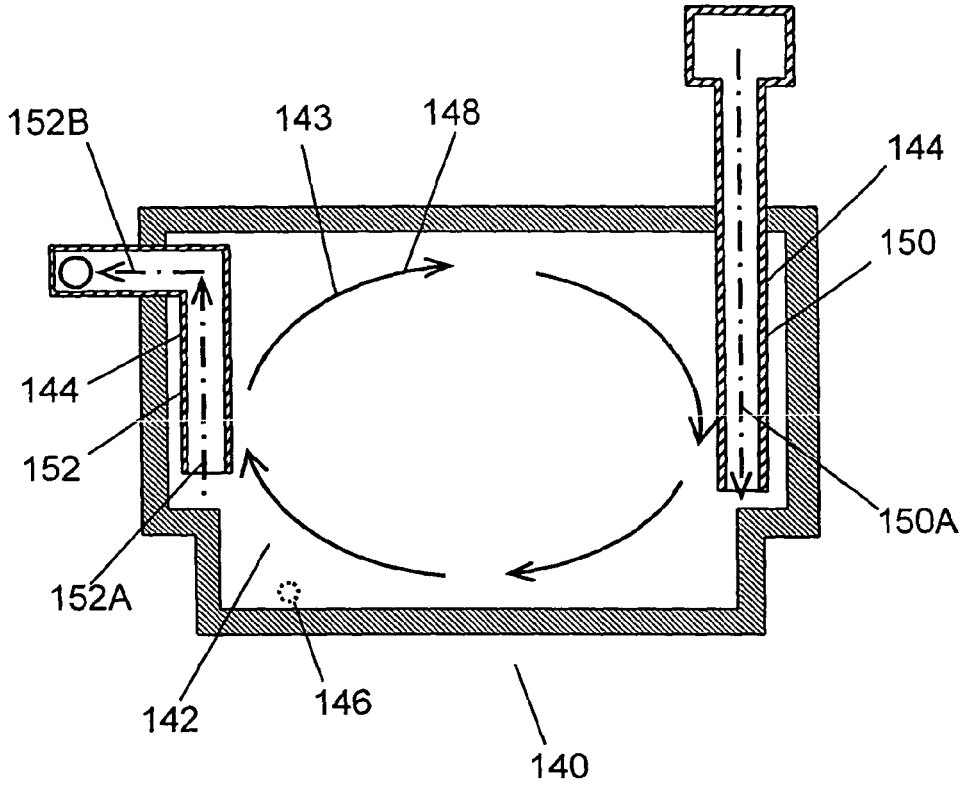
FIG. 7 is a sectional view of a suction muffler used in the hermetic compressor shown in FIG. 1.

Additionally, as shown in FIG. 7, gas flow forming part 144 may be constituted by outlet pipe 152 which opens into sound deadening space 142 while extending in an approximately vertical direction along the wall surface in a left end of sound deadening space 142. Further, gas flow forming part 144 may be constituted by inlet pipe 150 which opens into sound deadening space 142 while extending in the approximately vertical direction along the wall surface in a right end of sound deadening space 142.

Figure 8:
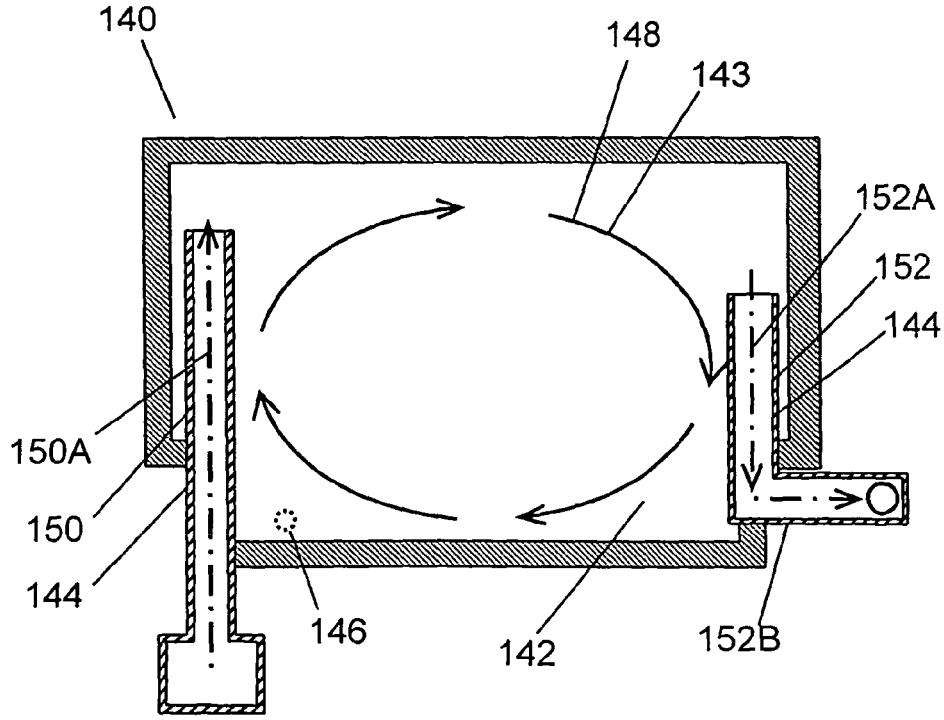
FIG. 8 is a sectional view of a suction muffler used in the hermetic compressor shown in FIG. 1.

Furthermore, as shown in FIG. 8, gas flow forming part 144 may be constituted by outlet pipe 152 which opens into sound deadening space 142 while extending in the approximately vertical direction along the wall surface in the right end of sound deadening space 142. Further, gas flow forming part 144 may be constituted by inlet pipe 150 which opens into sound deadening space 142 while extending in the approximately vertical direction along the wall surface in the left end of sound deadening space 142.

In other words, by the fact that gas flow forming part 144 is constituted by either one or both of outlet pipe 152 and inlet pipe 150, the inflow of oil 102 to compression chamber 134 is suppressed without additionally providing a special member. As a result, there is provided compressor 100 whose noise is low and which realizes a stable operation.

Further, outlet pipe 152 and inlet pipe 150 may be provided while being respectively extended along any end face of the upper end face, the lower end face, the left end face and the right end face of sound deadening space 142. In other words, it suffices if it is a constitution in which, in order to form annular gas flow 143 in sound deadening space 142, an energizing force for forming gas flow 143 is given to the refrigerant gas in sound deadening space 142.

As discussed above, in compressor 100, oil 102 is certainly discharged from muffler 140, and thus prevented from being sucked into compression chamber 134. As a result, the performance of compressor 100 becomes stable, and noise is suppressed as well.

INDUSTRIAL APPLICABILITY

As discussed above, in the hermetic compressor, since the performance of the compressor is stable and the noise is reduced, the hermetic compressor can be widely applied to an air conditioner, a vending machine, other refrigerating apparatus and the like, and is not limited to use in a household electric refrigerator.

The invention claimed is:

1. A hermetic compressor comprising:

a hermetic container for storing oil; and a compressing element accommodated in the hermetic container for compressing refrigerant gas;

wherein the compressing element has a compression chamber, a cylinder forming the compression chamber, a piston inserted into the cylinder for reciprocating therein, and a suction muffler having one end communicating with the compression chamber; and wherein the suction muffler has a sound deadening space having a first surface, an inlet pipe having one end opening in the sound deadening space and another end opening to the hermetic container, an outlet pipe having one end opening in the sound deadening space and another end opening to the compression chamber, said one end opening in the sound deadening space being disposed adjacent the first surface of the sound deadening space, a gas flow forming part forming a gas flow that enables the gas to flow in a constant direction in the sound deadening space by said one end opening of the outlet pipe disposed adjacent the first surface of the sound deadening space being open so that the gas flowing into the compression chamber from the one end opening of the outlet pipe disposed adjacent the first surface of the sound deadening space flows and circulates in a constant direction along the first surface of the sound deadening space and by opening the one end opening of the inlet pipe at a place which the gas flows into the sound deadening space, and an oil discharge opening provided in a downstream side of the gas flow in a lower part of the sound deadening space, wherein the outlet pipe includes a right angle bend in the sound deadening space, the outlet pipe being separate and disconnected from the inlet pipe, and the gas flow forming part is formed by a combination of the outlet pipe and the inlet pipe, and wherein the one end of the inlet pipe is located at a first portion of the inlet pipe and the one end of the outlet pipe is located at a first portion of the outlet pipe and the first portion of the outlet pipe is parallel to the first portion of the inlet pipe within the sound deadening space.

2. The hermetic compressor of claim 1, wherein the gas flow forming part is formed by providing the one end opening in the sound deadening space of the inlet pipe at a thin part of the sound deadening space, wherein the inlet pipe opens while being extended to any one of an upper end face, a lower end face, a left end face and a right end face of the sound deadening space, thereby constituting the gas flow forming part.

3. The hermetic compressor of claim 1, wherein the gas flow forming part is formed by providing the one end opening in the sound deadening space of the outlet pipe at a thin part of the sound deadening space, wherein the first surface is one of an upper end face, a lower end face, a left end face and a right end face of the sound deadening space, so that the outlet pipe opens while being extended to any one of the upper face, the lower face, the left face and the right face, thereby constituting the gas flow forming part.

4. The hermetic compressor of claim 3, wherein a portion of the outlet pipe is disposed adjacent the upper end face of the sound deadening space.

5. The hermetic compressor of claim 1, wherein a lower face of the sound deadening space is constituted by a substantially horizontal face, and the oil discharge opening is provided at an end part of the lower face of the sound deadening space.

6. The hermetic compressor of claim 1, wherein the suction muffler is formed with an annular gas passage in the sound deadening space.

7. The hermetic compressor of claim 5, wherein the suction muffler is formed with an annular gas passage in the sound deadening space.

8. The hermetic compressor of claim 2, wherein the lower end face of the sound deadening space is constituted by a substantially horizontal face, and the oil discharge opening is provided at an end part of the lower end face of the sound deadening space.

9. The hermetic compressor of claim 3, wherein the lower end face of the sound deadening space is constituted by a substantially horizontal face, and the oil discharge opening is provided at an end part of the lower end face of the sound deadening space.

10. The hermetic compressor of claim 4, wherein the lower end face of the sound deadening space is constituted by a substantially horizontal face, and the oil discharge opening is provided at an end part of the lower end face of the sound deadening space.

11. The hermetic compressor of claim 2, wherein the suction muffler is formed with an annular gas passage in the sound deadening space.

12. The hermetic compressor of claim 3, wherein the suction muffler is formed with an annular gas passage in the sound deadening space.

13. The hermetic compressor of claim 4, wherein the suction muffler is formed with an annular gas passage in the sound deadening space.

14. The hermetic compressor of claim 1, further comprising a visor, protruding as an eaves, above said oil discharge opening.

15. The hermetic compressor of claim 1, wherein a thin part of the sound deadening space is provided at a lower portion of a central part of the sound deadening space, and the one end opening in the sound deadening space of the inlet pipe and the one end opening in the sound deadening space of the outlet pipe are provided at the lower portion of the central part of the sound deadening space.

16. The hermetic compressor of claim 1, wherein the one end opening of the outlet pipe and the one end opening of the inlet pipe open in the same direction within the sound deadening space.

17. A hermetic compressor comprising:

a hermetic container for storing oil;

a compressing element accommodated in said hermetic container for compressing a refrigerant gas;

said compressing element comprising a cylinder, and a piston disposed in said cylinder for reciprocation, such that a compression chamber is defined by said cylinder and said piston; and a suction muffler having a sound deadening space therein defined within walls including a top wall, a bottom wall and side walls;

wherein said suction muffler comprises an inlet pipe, having an internal opening that opens into said sound deadening space and an external opening that opens outside said sound deadening space, for inlet of the refrigerant gas into said sound deadening space, an outlet pipe, having an internal opening that opens into said sound deadening space and an external opening that opens outside said sound deadening space, for outlet of the refrigerant gas from said sound deadening space, said external opening of said outlet pipe communicating with said compression chamber of said compressing element, and an oil discharge opening provided at a bottom part of said sound deadening space adjacent one of said side walls such that oil pooled near a junction of said bottom wall and said one of said side walls can discharge through said oil discharge opening, wherein the gas flowing into the compression chamber from the internal opening of the outlet pipe flows and circulates in a constant direction along one wall of the top wall, the bottom wall and the side walls of the sound deadening space by opening the internal opening of the outlet pipe adjacent to said one wall, and the internal opening of the inlet pipe opens at a place which the gas flows into the sound deadening space so as to constitute a gas flow forming part that causes a flow of the refrigerant gas along said bottom part of said sound deadening space in a constant direction toward said oil discharge opening to cause the oil in said sound deadening space to pool at said oil discharge opening, wherein the outlet pipe includes a right angle bend in the sound deadening space, the outlet pipe being separate and disconnected from the inlet pipe, and the gas flow forming part is formed by a combination of the outlet pipe and the inlet pipe, and wherein one end of the inlet pipe is located at a first portion of the inlet pipe in the sound deadening space and one end of the outlet pipe is located at a first portion of the outlet pipe in the sound deadening space and the first portion of the outlet pipe is parallel to the first portion of the inlet pipe within the sound deadening space.

18. The hermetic compressor of claim 17, wherein said at least one of said internal opening of said inlet pipe and said internal opening of said outlet pipe is disposed in a location within said sound deadening space so that said gas flow forming part causes the refrigerant gas to flow along a generally annular path within said sound deadening space.

19. The hermetic compressor of claim 18, wherein said sound deadening space comprises an upper portion and a lower portion, said lower portion being thinner than said upper portion; and said lower portion of said sound deadening space has a center portion and side portions on opposing sides of said center portion, said center portion being thinner than said side portions.

20. The hermetic compressor of claim 17, wherein said sound deadening space comprises an upper portion and a lower portion, said lower portion being thinner than said upper portion; and said lower portion of said sound deadening space has a center portion and side portions on opposing sides of said center portion, said center portion being thinner than said side portions.

21. The hermetic compressor of claim 17, further comprising a visor, protruding as an eaves, above said oil discharge opening.

22. The hermetic compressor of claim 17, wherein the internal opening of the outlet pipe and the internal opening of the inlet pipe open in the same direction within the sound deadening space.

* * * * *